US008957596B2

(12) United States Patent
Cho et al.

(10) Patent No.: US 8,957,596 B2
(45) Date of Patent: Feb. 17, 2015

(54) PREHEATING CONTROL DEVICE, LAMP DRIVING DEVICE INCLUDING THE SAME, AND PREHEATING CONTROL METHOD

(75) Inventors: Gye-Hyun Cho, Bucheon (KR); Sang-Cheol Her, Seoul (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 1039 days.

(21) Appl. No.: 13/027,755

(22) Filed: Feb. 15, 2011

(65) Prior Publication Data

US 2011/0204815 A1 Aug. 25, 2011

(30) Foreign Application Priority Data

Feb. 19, 2010 (KR) ..... 10-2010-0015410

(51) Int. Cl.
*H05B 41/36* (2006.01)
*H05B 41/298* (2006.01)

(52) U.S. Cl.
CPC ..... *H05B 41/298* (2013.01); *H05B 41/36* (2013.01)
USPC ..... 315/291; 315/112; 315/209 R

(58) Field of Classification Search
USPC ..... 315/112
See application file for complete search history.

(56) References Cited

U.S. PATENT DOCUMENTS

| | | | | |
|---|---|---|---|---|
| 4,538,093 | A * | 8/1985 | Melai | 315/219 |
| 5,828,187 | A * | 10/1998 | Fischer | 315/291 |
| 6,150,773 | A * | 11/2000 | Ribarich et al. | 315/291 |
| 6,501,235 | B2 * | 12/2002 | Ortmeyer | 315/307 |
| 6,933,684 | B2 * | 8/2005 | Yang et al. | 315/274 |
| 6,949,888 | B2 * | 9/2005 | Ribarich | 315/307 |
| 7,211,970 | B2 * | 5/2007 | Takahashi | 315/360 |
| 7,239,094 | B2 | 7/2007 | Radzinski et al. | |
| 7,279,844 | B2 | 10/2007 | Winkel et al. | |
| 7,298,099 | B2 * | 11/2007 | Ribarich | 315/308 |
| 7,378,804 | B2 * | 5/2008 | Mitsuyasu et al. | 315/291 |
| 7,436,123 | B2 * | 10/2008 | Hamamoto et al. | 315/219 |
| 8,063,588 | B1 * | 11/2011 | Ribarich et al. | 315/360 |
| 8,129,920 | B2 * | 3/2012 | Sasakawa | 315/287 |
| 8,253,351 | B2 * | 8/2012 | Yamamoto et al. | 315/307 |
| 8,502,475 | B2 * | 8/2013 | Matsuzaki et al. | 315/308 |

* cited by examiner

*Primary Examiner* — Alexander H Taningco
*Assistant Examiner* — Nelson Correa
(74) *Attorney, Agent, or Firm* — Okamoto & Benedicto LLP

(57) ABSTRACT

The present invention relates to a preheating control device controlling lamp preheating, a lamp driving device including the same, and a preheating control method thereof. A preheating control device according to an exemplary embodiment of the present invention generates a preheating control voltage that is changed according to a passage of a preheating time of a lamp and generation of a lamp current of the lamp. An oscillator signal having a frequency according to a preheating control voltage is generated, and if the lamp current is generated in the lamp, the preheating control voltage is changed to more than a predetermined reference voltage such that the frequency of the oscillator signal may be decreased.

20 Claims, 4 Drawing Sheets

PREHEATING CONTROL DEVICE, LAMP DRIVING DEVICE INCLUDING THE SAME, AND PREHEATING CONTROL METHOD

CROSS-REFERENCE TO RELATED APPLICATION

This application claims priority to and the benefit of Korean Patent Application No. 10-2010-0015410 filed in the Korean Intellectual Property Office on Feb. 19, 2010, the entire contents of which are incorporated herein by reference.

BACKGROUND OF THE INVENTION (a) Field of the Invention

The present invention relates to a preheating control device controlling an operation of a lamp driving device during preheating of a lamp, a lamp driving device including the same, and a preheating control method thereof.

(b) Description of the Related Art

A control method for controlling preheating of a lamp is divided into two methods. One is a linear method of linearly increasing a preheating frequency during a preheating period, and the other is a step method of increasing the preheating frequency step by step during the preheating period. Here, the preheating frequency means a frequency of a waveform for the voltage (hereinafter, lamp voltage) between both terminals of the lamp during the preheating period.

Generally, the preheating control method according to the step method may decrease the preheating time compared with the linear method. This is because the step method supplies a higher current to the filament of the lamp during the preheating period compared with the linear method.

In a case of firstly operating the lamp and a case in which the lamp is maintained in an off state for a predetermined period and is then turned on (hereinafter, a cold start), the two methods do not have the above-described problem. However, the two methods cause the above-described problem in a case (hereinafter, a hot start) in which the lamp is turned off and then is turned on after a short time. This is because the lamp voltage that is capable of turning on the lamp is different according to the temperature of the filament. In detail, as the filament temperature is increased, the lamp voltage that is capable of turning on the lamp is decreased.

Also, an operation of the lamp, that is, a period from the time that a switch (hereinafter, a lamp driving switch) controlling the turn-on to the time that the lamp is actually turned on, must be more than a predetermined threshold period that is determined by law. In the case of the cold start, a period of more than the threshold period must elapse, and then the lamp may be turned on. Accordingly, when the lamp driving switch is turned on in the general cold start, the problem that the lamp is turned on within the threshold period is not generated.

However, in the case of the hot start, the temperature of the lamp is high enough such that the lamp may be turned on at a low lamp voltage. According to the two methods, although the lamp may be turned on before the end of the threshold period, the turn-on of the lamp is suppressed by force after the threshold period in the case of the hot start.

According to the delay of the turn-on of the lamp by force, the filament of the lamp is over-preheated and unnecessary power consumption is generated by the current flowing in the filament.

The above information disclosed in this Background section is only for enhancement of understanding of the background of the invention and therefore it may contain information that does not form the prior art that is already known in this country to a person of ordinary skill in the art.

SUMMARY OF THE INVENTION

A preheating control device, a lamp driving device including the same, and a preheating control method capable of controlling a preheating time from a start time at which the lamp starts to a time at which the lamp is turned on are provided.

A preheating controlling method of a lamp according to the present invention includes: generating a preheating control voltage that is changed according to passage of a preheating time of the lamp and generation of a lamp current in the lamp; generating an oscillator signal having a frequency according to the preheating control voltage; and changing a preheating control voltage to a predetermined greater reference voltage if the lamp current is generated in the lamp to decrease the frequency of the oscillator signal, wherein the preheating period of the lamp is finished when the oscillator signal is decreased to a predetermined minimum frequency. The preheating controlling method may further include controlling the preheating current transmitted to the lamp during the preheating period of the lamp according to the oscillator signal.

The generation of the preheating control voltage may include: changing the preheating control voltage with a first slope from the first time that the preheating control voltage has passed the predetermined reference voltage; and changing the preheating control voltage with a second slope different from the first slope before the first time.

The decreasing of the frequency of the oscillator signal may include changing the preheating control voltage with a third slope at a time that the lamp current is generated to change the preheating control voltage to a preheating finish voltage different from the reference voltage, wherein the third slope is larger than the first and second slopes.

The preheating control voltage may be clamped to a predetermined voltage near the preheating finish voltage, and the oscillator signal is uniformly maintained with a minimum frequency. The reference voltage may be less than the preheating finish voltage, and the predetermined clamping voltage is a voltage near and more than the preheating finish voltage.

A preheating control device of a lamp according to the present invention includes: a preheating controller generating a preheating control voltage that is changed according to a passage of a preheating time of the lamp and the generation of the lamp current in the lamp; a lamp current sensing unit sensing the lamp current flowing in the lamp; and a current source supplying a preheating finish current to the preheating controller according to the control of the lamp current sensing unit, wherein the preheating control voltage is changed by the preheating finish current, and after the preheating control voltage reaches the predetermined preheating finish voltage, the frequency of the oscillator signal to control the preheating current generated during a preheating period for preheating the lamp is changed and maintained as a predetermined minimum frequency. The preheating control device may further include a first current source supplying a first current controlling the frequency of the oscillator signal, and a second current source supplying a first variable current controlling the frequency of the oscillator signal during the preheating period.

The frequency of the oscillator signal may be controlled by the first current and the first variable current, and after the preheating control voltage reaches the preheating finish voltage, the first variable current is blocked from the frequency control of the oscillator signal.

The preheating controller may generate the preheating control voltage that is changed by the second variable current and the preheating finish current during the preheating period. The level of the second variable current during the first period among the preheating period and the level of the second variable current after the first period is finished are different. The first period may be determined according to the time that the preheating control voltage reaches the reference voltage that is different from the preheating finish voltage. The level of the second variable current during the first period may be higher than the level of the second variable current after the first period is finished, and the level of the preheating finish current may be higher than the level of the second variable current during the first period.

The preheating control device may further include a capacitor supplied with the second variable current and the preheating finish current, the preheating control voltage is a voltage charged to the capacitor, and after the finish of the preheating period, the preheating control voltage is clamped to the predetermined clamping voltage. The preheating controller may include: a hysteresis comparator input with the preheating control voltage and comparing the predetermined reference voltage that is less than the preheating finish voltage and the preheating finish voltage with the preheating control voltage; a variable current source supplying the second variable current; and a clamping unit clamping the preheating control voltage to the clamping voltage. The second current source may further include a switch transmitting the second variable current to the outside, and the switch may be switching-operated according to the output signal of the hysteresis comparator.

A lamp driving device according to the present invention includes: an oscillator generating an oscillator signal controlling a preheating current supplied to a lamp during a preheating period of the lamp; and a preheating control device generating a preheating control voltage that is changed according to a passage of a preheating time of the lamp and the generation of the lamp current in the lamp, and controlling the oscillator such that if the lamp current is generated in the lamp, the preheating control voltage reaches a predetermined preheating finish voltage, and the frequency of the oscillator signal is decreased and maintained at a predetermined minimum frequency.

The preheating control device may include: a preheating controller generating the preheating control voltage; a lamp current sensing unit sensing the lamp current flowing in the lamp; a current source supplying a preheating finish current to the preheating controller according to the control of the lamp current sensing unit; a first current source supplying a first current controlling a frequency of the oscillator signal to the oscillator; and a second current source supplying a first variable current controlling the frequency of the oscillator signal during the preheating period to the oscillator. The frequency of the oscillator signal may be controlled by the first current and the first variable current, and after the preheating control voltage reaches the preheating finish voltage, the first variable current is not transmitted from the oscillator.

The preheating controller may generate the preheating control voltage that is changed by the second variable current and the preheating finish current during the preheating period, the level of the second variable current during the first period among the preheating period may be different from the second variable current after the first period is finished, and the first period may be determined according to a time that the preheating control voltage reaches the reference voltage that is different from the preheating finish voltage.

The preheating controller may include: a hysteresis comparator input with the preheating control voltage and comparing the predetermined reference voltage that is less than the preheating finish voltage and the preheating finish voltage with the preheating control voltage; and a variable current source supplying the second variable current, wherein the hysteresis comparator outputs a comparison signal such that if the preheating control voltage is more than the preheating finish voltage, the first variable current is not supplied to the oscillator.

The present invention provides a preheating control device controlling a preheating time of the lamp according to a state in which the lamp starts, a lamp driving device including the same, and a preheating control method.

Particularly, a preheating control device lamp controlling the switching frequency of the power switch supplying the power, the lamp driving device including the same, and the preheating control method thereof are provided.

DETAILED DESCRIPTION OF THE EMBODIMENTS

Figure 1:
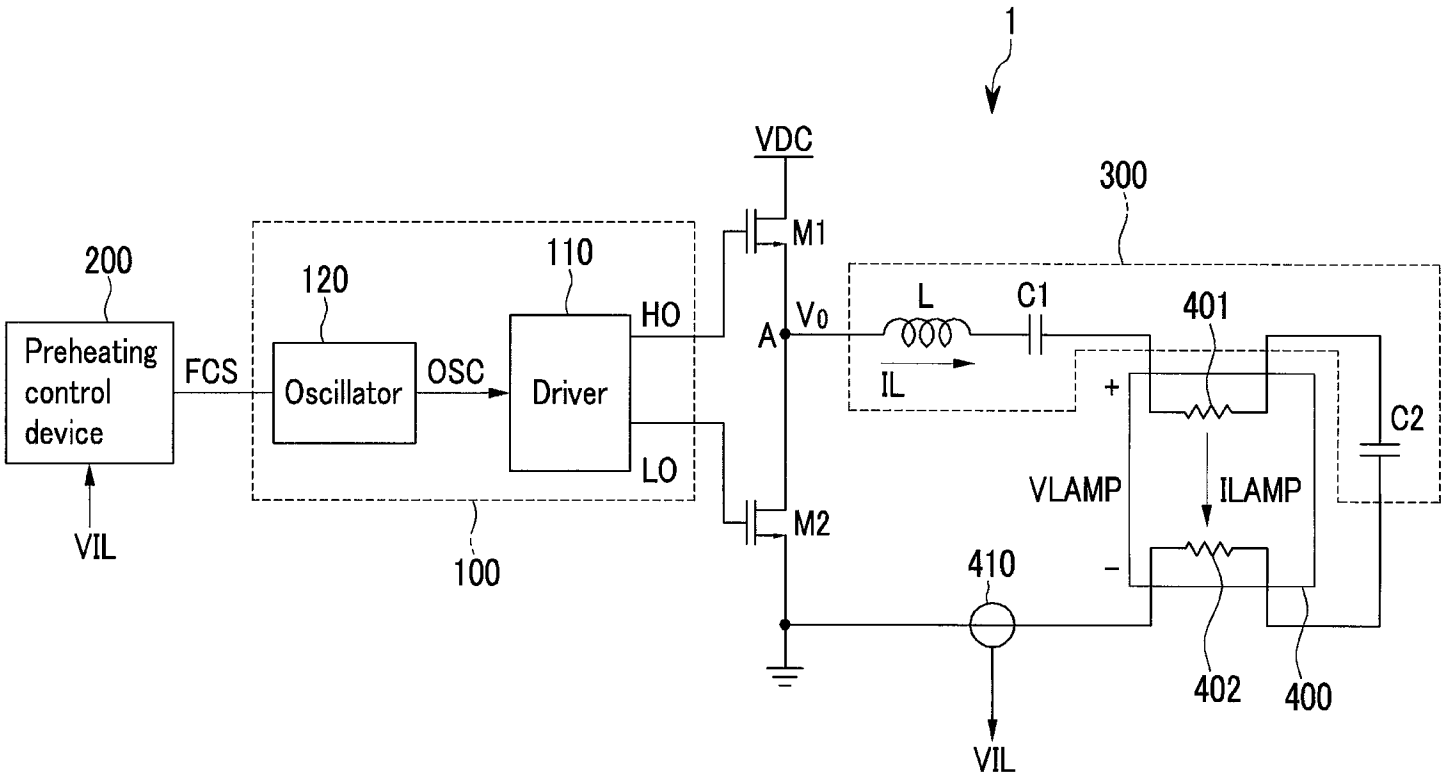
FIG. 1 is a view of a lamp driving device including a preheating control device according to an exemplary embodiment of the present invention and a lamp connected thereto.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

In the following detailed description, only certain exemplary embodiments of the present invention have been shown and described, simply by way of illustration.

FIG. 1 is a view of a lamp driving device including a preheating control device according to an exemplary embodiment of the present invention and a lamp connected thereto.

As shown in FIG. 1, a lamp driving device 1 includes a controller 100, a preheating control device 200, a lamp controller 300, a high side switch M1, and a low side switch M2. The high side switch M1 and the low side switch M2 as MOSFETs (metal-oxide semiconductor field effect transistors) are transistors of an n-channel type, but an exemplary embodiment of the present invention is not limited thereto.

The controller 100 controls switching operations of the high side switch M1 and the low side switch M2. In detail, the controller 100 transmits a high side gate signal HO and a low side gate signal LO to the gate electrode of the high side switch M1 and the gate electrode of the low side switch M2 to control the switching operation of the high side switch M1 and the low side switch M2. The controller 100 includes a driving unit 110 and an oscillator 120 generating an oscillator signal OSC.

The driving unit 110 generates the high side gate signal HO and the low side gate signal LO according to the oscillator signal OSC. The oscillator signal OSC has a predetermined cycle to control the switching operation of the high side switch M1 and the low side switch M2. The drain electrode of the high side switch M1 is connected to a power source VDC, and the source electrode thereof is connected to the drain electrode of the low side switch M2 at the node A. The source of the low side switch M2 is grounded. The power source VDC supplies the DC voltage to the drain electrode of the high side switch M1.

During a lamp preheating period for lamp turn-on, the oscillator 120 generates the oscillator signal OSC of a higher frequency than the state after the lamp turn-on according to the frequency control signal FCS output from the preheating control device 200, that is, the lamp normal state. The oscillator 120 determines the frequency of the oscillator signal OSC according to the frequency control signal FCS.

The lamp controller 300 includes an inductor L, a capacitor C1, and a capacitor C2. One terminal of the inductor L is applied with the operation voltage V0 of the node A. The lamp 400 according to an exemplary embodiment of the present invention includes two filaments 401 and 402. The terminals of the capacitor C2 are respectively connected to one terminal of the two filaments 401 and 402, thereby being connected in parallel to the lamp 400. Also, one terminal of the capacitor C1 is connected to the other terminal of the filament 401, and the other terminal thereof is connected to the other terminal of the inductor L. The lamp 400, the inductor L, the capacitor C1, and the capacitor C2 form a resonance circuit. The operation voltage Vo is determined according to the switching operation of the high side switch M1 and the low side switch M2, and the operation voltage Vo is supplied to the lamp controller 300. The current IL is generated in the inductor L by the operation voltage Vo, and the current IL forms a sine wave by the resonance.

The current sensing unit 410 is positioned between the lamp 400 and the ground such that it detects the current flowing to the lamp 400 to generate the sensing voltage VIL. The current sensed by the current sensing unit 410 during the preheating period is a lamp current ILAMP.

The preheating control device 200 according to an exemplary embodiment of the present invention quickly decreases the switching frequency within the short time if the lamp current ILAMP is sensed in the lamp preheating process before the lamp 400 is turned on for the lamp 400 to be the normal state. The current flowing between the filament 401 and the filament 402 of the lamp 400 is the lamp current ILAMP, and the voltage between both terminals of the lamp 400 is the lamp voltage VLAMP. The voltage between both terminals of the lamp 400 is the voltage between the other terminal of the filament 401 and the other terminal of the filament 402.

The switching frequency means the switching frequency of the high side switch M1 and the low side switch M2. The oscillator signal OSC determines the switching frequency. Accordingly, the preheating control device 200 decreases the frequency of the oscillator signal OSC if the lamp current ILAMP is generated in the preheating process before the lamp 400 is turned on such that the lamp 400 is operated in the normal state within the short time.

The current IL preheating the lamp 400 is supplied to the lamp 400 during the preheating period. Hereafter, the current IL supplied to the lamp 400 only during the preheating period is referred to as a preheating current. The preheating current IL may be uniformly increased or may be maintained with a predetermined value during the preheating period.

In general, the preheating period of the lamp is uniformly determined under an integrated circuit design to control the operation of the lamp. Before the lamp is turned on, although the lamp current ILAMP is generated within the predetermined preheating period, the integrated circuit preheats the lamp during the predetermined preheating time regardless of the lamp turn-on. This may reduce of the lifetime of the lamp.

The conventional lamp driving device supplies the preheating current to the lamp to increase the voltage of both terminals of the lamp to the predetermined turn-on voltage of the lamp for the turn-on. The preheating current according to the step method during the preheating period is uniformly maintained with the predetermined value, and the preheating current according to the linear method is gradually increased. The preheating current according to the step method is larger than the current supplied to the lamp in the lamp normal state. The preheating current according to the linear method is larger than the current supplied to the lamp in the lamp normal state during the predetermined period of the preheating period.

Accordingly, when preheating the lamp according to the conventional method, after the lamp current is generated and the lamp is turned on, the preheating current that is larger than the current (hereinafter, a normal state current) supplied to the lamp in the lamp normal state is supplied to the lamp such that the lifetime of the lamp is decreased.

To solve this problem, the preheating control device 200 according to an exemplary embodiment of the present invention quickly decreases the frequency of the oscillator signal OSC to the predetermined frequency (FIG. 3B "fm") in synchronization with the time that the lamp current ILAMP starts to flow. The decreased frequency of the oscillator signal OSC is maintained as the predetermined frequency fm, and the operation frequency of the lamp controller 300 is quickly decreased and maintained. Thus, the current IL is quickly increased and reaches the normal state current, and then is uniformly maintained.

As described above, an exemplary embodiment of the present invention may prevent the lamp damage by the preheating current supplied after the lamp turn-on. Also, the preheating control device according to an exemplary embodiment of the present invention quickly increases the current IL after the lamp turn-on and maintains it as the normal state current, thereby reducing the time required to decrease the current IL to the normal state current after the preheating current is gradually increased according to the conventional linear method during the preheating period.

The preheating control device 200 transmits the frequency control signal FCS to the oscillator 120. The frequency control signal FCS may be the current signal. The oscillator 120 decreases the frequency of the oscillator signal OSC during the preheating period according to the frequency control signal FCS. If the frequency of the oscillator signal OSC is decreased, the preheating current IL is increased.

Figure 2:
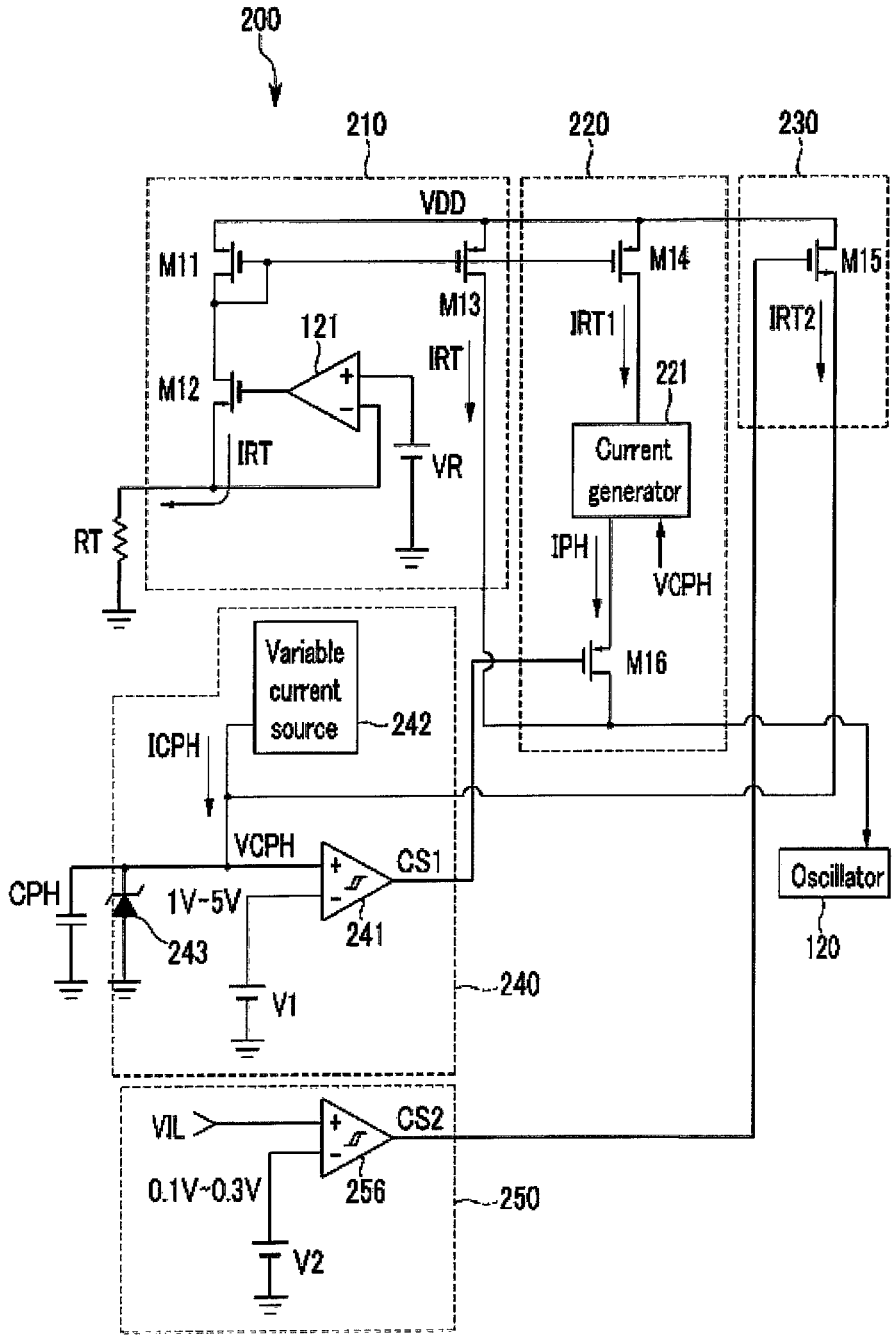
FIG. 2 is a view showing a configuration of a preheating control device 200 according to an exemplary embodiment of the present invention.

FIG. 2 is a view showing a configuration of a preheating control device 200 according to an exemplary embodiment of the present invention. The configuration of the preheating control device 200 shown in FIG. 2 is only an example, and the present invention is not limited thereto.

As shown in FIG. 2, the preheating control device 200 includes the first current source 210, the second current source 220, a preheating finish current source 230, a preheating controller 240, and a lamp current sensing unit 250.

The first current source 210 generates and supplies the first current IRT to the oscillator, and forms the current mirror along with the second current source. The first current source 210 includes three transistors M11-M13, a comparator 121, and the reference voltage source VR. The resistor RT is connected outside the current source of the first current source 210, and the value of the first current IRT is determined according to the resistor RT.

The transistor M11 includes the source electrode applied with the voltage VDD, the gate electrode connected to the diode connected, and the drain electrode. The transistor M13 includes the gate electrode connected to the gate electrode of the transistor M11, the source electrode applied with the voltage VDD, and the drain electrode outputting the first current IRT.

The transistor M12 includes the drain electrode connected to the drain electrode of the transistor M11, the source electrode connected to one terminal of the resistor RT, and the gate electrode connected to the output terminal of the comparator 121.

The comparator 121 includes the inversion terminal (−) connected to one terminal of the resistor RT and the non-inversion terminal (+) input with the reference voltage VR.

The comparator 121 controls the transistor M12 such that the voltage of the inversion terminal (−) is the same as the voltage of the non-inversion terminal (+). Here, the first current IRT flowing into the resistor RT through the transistor M11 and the transistor M12 is uniformly controlled, and the first current IRT is copied through the transistor M12 forming the current mirror along with the transistor M11. In an exemplary embodiment of the present invention, the width/length ratio of the channel of the transistor M11 and the transistor M13 is the same such that the current copy ratio is 1:1. The first current IRT is supplied to the oscillator 120.

The second current source 220 includes the transistor M14 forming the current mirror alone with the first current source 210, and copies the first current IRT with a predetermined ratio such that the first variable current IPH of which the size is changed according to the passage of the time during the preheating time.

The second current source 220 includes the transistor M14, the current generator 221, and the transistor M16. The transistor M14 includes the source electrode applied with the voltage VDD, the gate electrode connected to the gate electrode of the transistor M11 and the transistor M13, and the drain electrode. The transistor M14 forms the current mirror along with the transistor M11, thereby copying the first current IRT with the predetermined ratio to generate the current IRT1.

The current generator 221 maintains the current IRT1 as the uniform value during the first preheating period among the preheating period, and generates the first variable current IPH that is decreased during the second preheating period. In detail, the current generator 221 receives the preheating control voltage VCPH from the preheating controller 240, and controls the current IRT1 according to the level of the preheating control voltage VCPH to generate the first variable current IPH. The first variable current IPH will be described with reference to FIG. 4.

Figure 4:
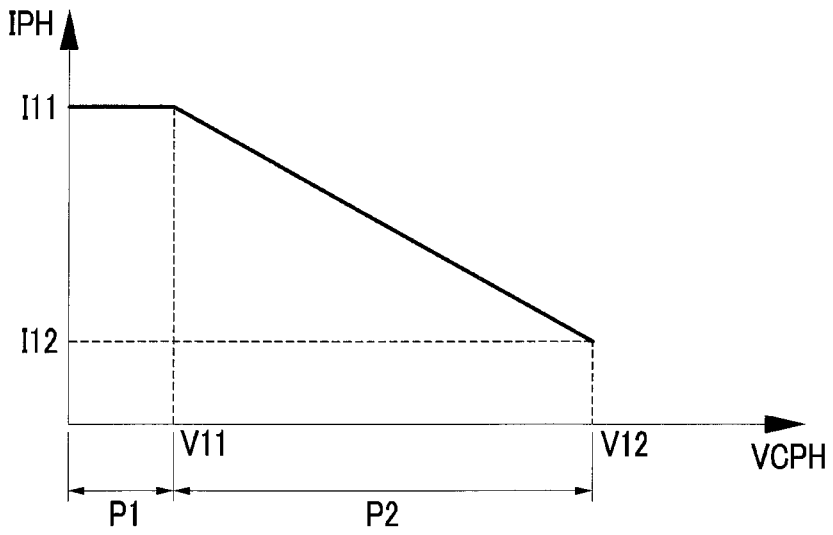
FIG. 4 is a view showing the first variable current IPH according to an exemplary embodiment of the present invention.

FIG. 4 is a view showing the first variable current IPH according to an exemplary embodiment of the present invention.

The preheating control voltage VCPH is increased during the preheating period. The current generator 221 controls and outputs the first variable current IPH as the current I11 during the first period P1 in which the preheating control voltage VCPH reaches the first control voltage V11. After the first period P1, the current generator 221 gradually decreases the first variable current IPH. Thus, after the first period P1, the first variable current IPH is decreased from the current I11 to the current I12 during the second period P2 in which the preheating control voltage VCPH is gradually increased to the second control voltage V12. FIG. 4 shows the first variable current IPH that is linearly decreased during the second period P2, however the present invention is not limited thereto.

The transistor M16 includes the source electrode connected to the current generator 221, the gate electrode connected to the preheating controller 240, and the drain electrode connected to the oscillator 120. The transistor M16 is maintained in the turn-on state by the comparison signal CS1 output from the preheating controller 240 during the preheating period. After the preheating period is finished, the transistor M16 is turned off by the comparison signal CS1. The first variable current IPH is transmitted to the oscillator 120 during the period in which the transistor M16 is in the on state, and if the transistor M16 is in the off state, the first variable current IPH is blocked from the outside.

In an exemplary embodiment of the present invention, the current generator 221 controls the first variable current IPH according to the level of the preheating control voltage VCPH, however the present invention is not limited thereto. The first period P1 in which the preheating control voltage VCPH is increased to the first control voltage V11 may be previously determined in the current generator 221. Also, after the first period P1, the current generator 221 may detect the time that the preheating control voltage VCPH reaches the second control voltage V12 through the comparison signal CS1. Accordingly, the current generator 221 maintains the first variable current IPH as the current I11 during the predetermined first period, and may decrease the first variable current IPH at the time that the preheating control voltage VCPH reaches the second control voltage V12 after the first period.

Also, if the preheating control voltage VCPH reaches the second control voltage V12, the transistor M16 is turned off by the comparison signal CS1 such that the first variable current IPH is no longer supplied to the oscillator 120.

The preheating finish current source 230 transmits the preheating finish current IRT2 to the preheating controller 240 in synchronization with the time that the lamp current ILAMP is generated.

The preheating finish current source 230 includes the transistor M15. The transistor M15 includes the gate electrode connected to the lamp current sensing unit 250, the drain electrode applied with the voltage VDD, and the source electrode connected to the capacitor CPH. The preheating finish current IRT2 as the current that is larger than the first current IRT may be the current that is amplified with the predetermined ratio. In detail, the preheating finish current IRT2 may be the current that is larger than the second variable current ICPH during the first period.

If the sensing voltage VIL is generated, the lamp current sensing unit 250 operates the preheating finish current source 230. In detail, the lamp current sensing unit 250 includes the hysteresis comparator 251, and the hysteresis comparator 251 generates the comparison signal CS2 of the high level if the sensing voltage VIL is generated. The comparison signal CS2 of the high level turns on the transistor M16.

The hysteresis comparator 251 includes the non-inversion terminal (+) input with the sensing voltage VIL and the inversion terminal (−) input with the reference voltage V2. The reference voltage V2 input to the inversion terminal (−) as a predetermined voltage is provided with the reference voltage of 0.1V and 0.2V according to the hysteresis characteristic in an exemplary embodiment of the present invention. This is one example, and the present invention is not limited thereto.

The hysteresis comparator 251 outputs the comparison signal CS2 of the low level if the sensing voltage VIL is less than 0.1V, while if it is more than 0.2V, the comparison signal CS2 of the high level is output. The hysteresis comparator 251 maintains the high level in the state in which the comparison signal CS2 is the high level according to the hysteresis characteristic if the sensing voltage VIL is not less than 0.1V. Also, the hysteresis comparator 251 maintains the low level in the state in which the comparison signal CS2 is the low level according to the hysteresis characteristic if the sensing voltage VIL is not over 0.2V.

If the lamp current ILAMP flows such that the sensing voltage VIL is generated, the lamp current sensing unit 250 generates the comparison signal CS2 of the high level.

The preheating controller 240 generates the preheating control voltage VCPH that is changed during the preheating period, and changes the preheating control voltage VCPH to a predetermined voltage from the time that the lamp current ILAMP is generated and uniformly maintains it.

In detail, the preheating controller 240 generates the preheating control voltage VCPH that is changed during the preheating period, and increases the preheating control voltage VCPH to the predetermined voltage from the time that the lamp current ILAMP is generated and uniformly maintains it. The predetermined voltage is the voltage that is more than the second control voltage V12. The preheating controller 240 may form the difference between the increasing slope of the preheating control voltage VCPH during the first period and the increasing slope of the preheating control voltage VCPH during the second period. Also, among the second period, the preheating controller 240 may differentiate the difference for the increasing slope of the preheating control voltage VCPH with reference to the time that the lamp current ILAMP is generated.

The preheating controller 240 includes the hysteresis comparator 241, the variable current source 242, and the clamping circuit 243. The preheating controller 240 is connected to the capacitor CPH outside, and transmits the second variable current ICPH and the preheating finish current IRT2 to the capacitor CPH to generate the preheating control voltage VCPH. The preheating controller 240 control the preheating period of the lamp 400, and executes the function of controlling the preheating current according to the passage of the time. In detail, the preheating controller 240 generates the preheating control voltage VCPH by differentiating the changing slope according to the passage of the time and the generation of the lamp current ILAMP. The current transmitted to the oscillator 120 is changed according to the preheating control voltage such that the frequency of the oscillator signal OSC is changed according to the preheating control voltage and the preheating current is also changed.

The hysteresis comparator 241 includes the non-inversion terminal (+) input with the preheating control voltage VCPH and the inversion terminal (−) input with the reference voltage VR1. The reference voltage V1 input to the inversion terminal (−) as the predetermined voltage is provided as the voltage of 1V and 5V according to the hysteresis characteristic in an exemplary embodiment of the present invention. For convenience of description according to the exemplary embodiments of the present invention, the first control voltage V11 is determined as 1V and the second control voltage V12 is determined as 5V. This is only one example, and the present invention is not limited thereto.

If the preheating control voltage VCPH is less than 1V, the hysteresis comparator 241 outputs the comparison signal CS1 of the low level, if it is more than 5V, the hysteresis comparator 241 outputs the comparison signal CS1 of the high level. The hysteresis comparator 241 maintains the high level in the state in which the comparison signal CS1 is the high level according to the hysteresis characteristic if the preheating control voltage VCPH is not less than 1V. Also, the hysteresis comparator 241 maintains the low level in the state in which the comparison signal CS2 is the low level according to the hysteresis characteristic if the preheating control voltage VCPH is not over 5V.

The clamping unit 243 clamps the preheating control voltage VCPH to the second control voltage, that is, a predetermined clamping voltage VCL of more than 5V. The clamping unit 243 may be realized as a zener diode having the clamping voltage VCL as a breakdown voltage. The present invention is not limited thereto. If the capacitor CPH is charged by the second variable current ICPH and the preheating finish current IRT2 such that the preheating control voltage VCPH is increased and reaches the clamping voltage VCL, the zener diode is turned on such that the preheating control voltage VCPH is not increased and is uniformly maintained as the clamping voltage VCL.

The variable current source 242 generates the second variable current ICPH to generate the preheating control voltage VCPH. The variable current source 242 controls the second variable current ICPH according to the preheating control voltage VCPH, thereby controlling the increasing slope of the preheating control voltage VCPH.

Also, the variable current source 242 may generate the second variable current ICPH having the predetermined level during the predetermined the first period P1 and having the different level after the first period P1.

The variable current source 242 may generate the second variable current ICPH only during the preheating period. The preheating period is finished at the time that the lamp current is generated. However, at this time, the preheating period is at least the time that is longer than a predetermined preheating time determined by law.

Next, the second variable current ICPH will be described with reference to FIG. 5.

Figure 5:
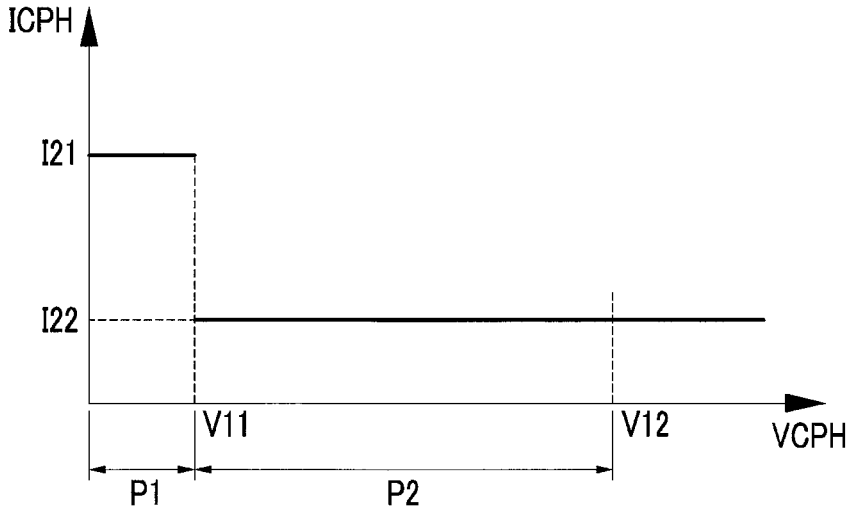
FIG. 5 is a view showing the second variable current for a variable current source 242 according to an exemplary embodiment of the present invention.

FIG. 5 is a view showing the second variable current for a variable current source 242 according to an exemplary embodiment of the present invention.

As shown in FIG. 5, the second variable current ICPH is maintained as the current I21 during the first period P1 before the preheating control voltage VCPH reaches the reference voltage V11. Also, after the first period P1, the second variable current ICPH is maintained as the current I22 that is less than the current I21.

The preheating control device according to an exemplary embodiment of the present invention finishes the preheating period if the preheating control voltage VCPH reaches the second control voltage V12. After the preheating period, the uniform current is only supplied to the oscillator 120. If the lamp current ILAMP is generated among the preheating period, the preheating period must be quickly finished such that the preheating control voltage VCPH is quickly increased. To quickly increase the preheating control voltage VCPH, the preheating finish current IRT2 of the preheating finish current source 230 is supplied to the capacitor CPH after the time of the generation of the lamp current ILAMP.

The oscillator 120 determines the frequency of the oscillator signal OSC according to the size of the current transmitted from the preheating control device 200. In detail, the frequency of the oscillator signal OSC is proportional to the size of the current transmitted from the preheating control device 200.

Figure 3A:
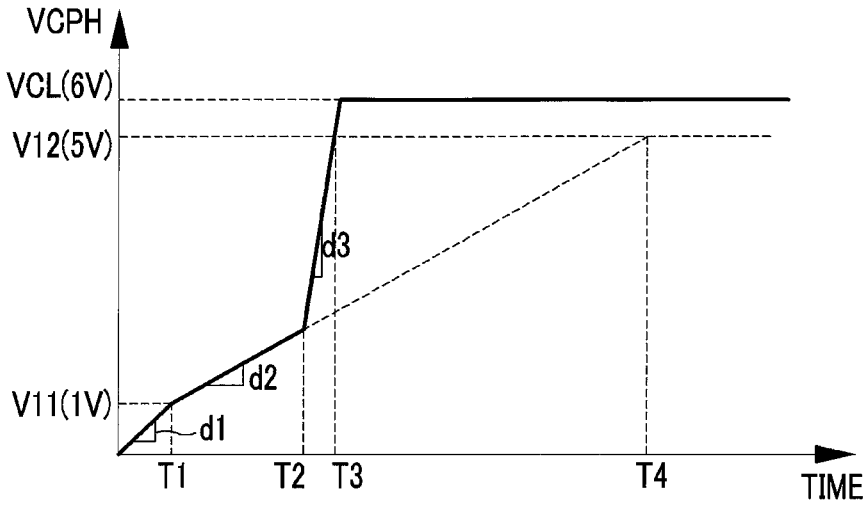
FIG. 3A and FIG. 3B are views showing a preheating control voltage VCPH of a frequency of an oscillator signal OSC for explaining an operation of a preheating control device according to an exemplary embodiment of the present invention.
Figure 3B:
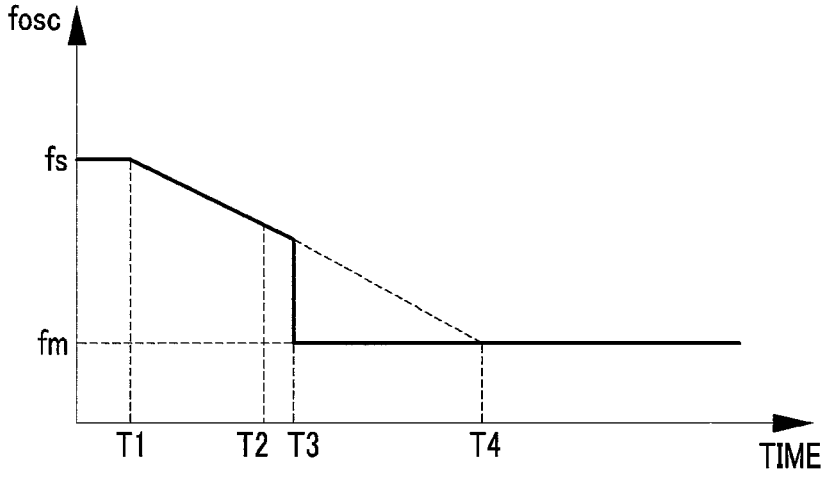

FIG. 3A and FIG. 3B are views showing a preheating control voltage VCPH of a frequency of an oscillator signal OSC for explaining an operation of a preheating control device according to an exemplary embodiment of the present invention. In FIG. 3A, the reference voltage V11 is determined as 1V, the preheating finish voltage V12 is determined as 5V, and the clamping voltage VCL is determined as 6V. However, the present invention is not limited thereto. The reference voltage V1 input to the inversion terminal (−) of the hysteresis comparator 241 is designed to provide the reference voltage V11 and the preheating finish voltage V12 as the comparison voltage according to the hysteresis characteristic.

As shown in FIG. 3A, if the preheating control device 200 starts to be operated, the preheating control voltage VCPH is increased to the first predetermined slope d1 by the second variable current ICPH. The period from the operation start time of the preheating control device 200 to the time T1 that the preheating control voltage VCPH reaches the first control voltage V11 corresponds to the first period P1 of FIGS. 4 and 5. During the first period P1, the frequency fosc of the oscillator signal OSC is uniformly maintained as an initial predetermined frequency fs by the first current IRT and the first variable current IPH.

After the time T1, preheating control voltage VCPH is generated by the second variable current ICPH such that the increasing slope d2 of the preheating control voltage VCPH is decreased rather than the increasing slope d1. Also, after the time T1, the first variable current IPH is decreased and the frequency fosc is decreased.

If the lamp current is generated at the time T2, the preheating finish current IRT2 of the preheating finish current source 230 starts to be supplied to the capacitor CPH by the comparison signal CS2, and the preheating control voltage VCPH starts to quickly increase to the increasing slope d3.

If the preheating control voltage VCPH reaches the second control voltage V12 at the time T3, the comparison signal CS1 becomes the high level, and the transistor M16 is turned off. Thus, the first current IRT is only supplied to the oscillator 120 such that the frequency fosc is uniformly maintained as the minimum frequency fmin.

The dotted line shown in FIG. 3B shows the change of the frequency fosc in the case that the lamp current is not generated within the preheating period. As shown in FIG. 3B, the preheating period is the period to the time T4. Accordingly, as shown in FIGS. 3A and 3B, if the lamp current ILAMP is not generated with the period of the time T4, the preheating period is the period to the time T4. However, as described above, when the lamp current is generated at time T2, according to the conventional method, the frequency fosc must be gradually decreased according to the slope indicated by the dotted line of FIG. 3B and reach the frequency fm, and the current IL becomes the normal state current. However, in an exemplary embodiment of the present invention, the current IL reaches the normal state current at the time T3 such that the period in which the lamp is changed from the preheating state into the normal state is reduced.

Also, the preheating period is finished at the time T3 at which the lamp current is generated such that it may be prevented that the preheating period is unnecessary elongated such that the preheating current of more than the normal state current is generated.

Accordingly, the exemplary embodiment of the present invention provides the preheating control device and the preheating control method capable of preventing the reduction of the lifetime of the lamp and elongating the lifetime of the lamp.

The drawings and the detailed description described above are examples for the present invention and are provided to explain the present invention, and the scope of the present invention described in the claims is not limited thereto. Therefore, it will be appreciated to those skilled in the art that various modifications may be made and other equivalent embodiments are available. Accordingly, the actual scope of the present invention must be determined by the spirit of the appended claims.

<Description of Symbols> controller 100, preheating control device 200, lamp controller 300, controller 100, preheating control device 200, power supply unit 300, high side switch M1, low side switch M2, driving unit 110, oscillator 120 preheating control device 200, first current source 210, second current source 220, preheating finish current source 230, preheating controller 240, lamp current sensing unit 250 inductor L, capacitor (C1, C2, CPH), filament 401 and 402 transistor (M11, M12, M13, M14, M15, M16), resistor (RT)

hysteresis comparator 241 and 256, variable current source 242, current generator 221

What is claimed is:

1. A preheating controlling method of a lamp, comprising:

generating a preheating control voltage that is changed according to passage of a preheating time of the lamp and generation of a lamp current in the lamp;

generating an oscillator signal having a frequency according to the preheating control voltage; and changing the preheating control voltage to a predetermined reference voltage that is greater than the preheating control voltage to decrease the frequency of the oscillator signal, wherein a preheating period of the lamp is finished if the oscillator signal is changed to a predetermined reference frequency.

2. The preheating controlling method of claim 1, further comprising controlling a preheating current transmitted to the lamp during the preheating period of the lamp according to the oscillator signal.

3. The preheating controlling method of claim 1, wherein the generation of the preheating control voltage includes:

changing the preheating control voltage with a first slope from a first time that the preheating control voltage has passed the predetermined reference voltage; and changing the preheating control voltage with a second slope different from the first slope before the first time.

4. The preheating controlling method of claim 3, wherein the frequency of the oscillator signal is decreased by changing the preheating control voltage with a third slope at a time that the lamp current is generated to change the preheating control voltage to a preheating finish voltage different from the predetermined reference voltage, wherein the third slope is larger than the first and second slopes.

5. The preheating control method of claim 4, wherein the preheating control voltage is clamped to a predetermined voltage near the preheating finish voltage, and the oscillator signal is uniformly maintained with the reference frequency.

6. The preheating control method of claim 5, wherein the reference voltage is less than the preheating finish voltage, and the predetermined clamping voltage is a voltage near or more than the preheating finish voltage.

7. A preheating control device of a lamp comprising:

a preheating controller generating a preheating control voltage that is changed according to a passage of a preheating time of the lamp and generation of a lamp current in the lamp;

a lamp current sensing unit sensing the lamp current flowing in the lamp; and a current source supplying a preheating finish current to the preheating controller according to a control of the lamp current sensing unit, wherein the preheating control voltage is changed by the preheating finish current, and after the preheating control voltage reaches the predetermined preheating finish voltage, the frequency of an oscillator signal to control a preheating current generated during a preheating period for preheating the lamp is changed and maintained as a predetermined reference frequency of the oscillator signal.

8. The preheating control device of claim 7, further comprising:

a first current source supplying a first current controlling the frequency of the oscillator signal; and a second current source supplying a first variable current controlling the frequency of the oscillator signal during the preheating period.

9. The preheating control device of claim 8, wherein the frequency of the oscillator signal is controlled by the first current and the first variable current, and after the preheating control voltage reaches the preheating finish voltage, the first variable current is blocked from the frequency control of the oscillator signal.

10. The preheating control device of claim 7, wherein the preheating controller generates the preheating control voltage that is changed by a second variable current and the preheating finish current during the preheating period, wherein the level of the second variable current during a first period among the preheating period and a level of the second variable current after the first period is finished are different.

11. The preheating control device of claim 10, wherein the first period is determined according to a time that the preheating control voltage reaches a reference voltage that is different from the preheating finish voltage.

12. The preheating control device of claim 11, wherein the level of the second variable current during the first period is higher than the level of the second variable current after the first period is finished, and a level of the preheating finish current is higher than the level of the second variable current during the first period.

13. The preheating control device of claim 10, further comprising a capacitor supplied with the second variable current and the preheating finish current, the preheating control voltage is a voltage charged to the capacitor, and after the finish of the preheating period, the preheating control voltage is clamped to the predetermined clamping voltage.

14. The preheating control device of claim 13, wherein the preheating controller includes:

a hysteresis comparator that is input with the preheating control voltage and comparing a predetermined reference voltage with the preheating control voltage;

a variable current source supplying the second variable current; and a clamping unit clamping the preheating control voltage to the clamping voltage.

15. The preheating control device of claim 14, wherein the variable current source further includes a switch transmitting the second variable current to the outside, and the switch is switching-operated according to an output signal of the hysteresis comparator.

16. A lamp driving device comprising:

an oscillator generating an oscillator signal controlling a preheating current supplied to a lamp during a preheating period of the lamp; and a preheating control device generating a preheating control voltage that is changed according to a passage of a preheating time of the lamp and a generation of a lamp current in the lamp and controlling the oscillator such that in response to detecting that the lamp current starts to flow in the lamp, the preheating control voltage reaches a predetermined preheating finish voltage and the frequency of the oscillator signal is changed and maintained at a predetermined reference frequency.

17. The lamp driving device of claim 16, wherein the preheating control device includes:

a preheating controller generating the preheating control voltage;

a lamp current sensing unit sensing the lamp current flowing in the lamp;

a current source supplying a preheating finish current to the preheating controller according to the control of the lamp current sensing unit;

a first current source supplying a first current controlling a frequency of the oscillator signal; and a second current source supplying a first variable current controlling the frequency of the oscillator signal during the preheating period to the oscillator.

18. The lamp driving device of claim 17, wherein the frequency of the oscillator signal is controlled by the first current and the first variable current, and after the preheating control voltage reaches the preheating finish voltage, the first variable current is not transmitted from the oscillator.

19. The lamp driving device of claim 18, wherein the preheating controller generates the preheating control voltage that is changed by the second variable current and the preheating finish current during the preheating period, a level of the second variable current during the first period among the preheating period is different from the level of the second variable current after the first period is finished, and the first period is determined according to a time that the preheating control voltage reaches a reference voltage that is different from the preheating finish voltage.

20. The lamp driving device of claim 19, wherein the preheating controller includes:

a hysteresis comparator that is input with the preheating control voltage and comparing a predetermined reference voltage with the preheating control voltage; and a variable current source supplying the second variable current, wherein the hysteresis comparator outputs a comparison signal such that if the preheating control voltage is more than the preheating finish voltage, the first variable current is not supplied to the oscillator.

* * * * *